US006675556B2

(12) United States Patent
Bertuzzi et al.

(10) Patent No.: US 6,675,556 B2
(45) Date of Patent: Jan. 13, 2004

(54) METHOD AND UNIT FOR FORMING A TUBULAR WRAPPING ABOUT A PRODUCT

(75) Inventors: Ivanoe Bertuzzi, Casalecchio di Reno (IT); Alver Tacchi, Bologna (IT); Fiorenzo Draghetti, Medicina (IT)

(73) Assignee: G.D Societa 'per Azioni, Bologna (IT)

( * ) Notice: Subject to any disclaimer, the term of this patent is extended or adjusted under 35 U.S.C. 154(b) by 0 days.

(21) Appl. No.: 10/157,513

(22) Filed: May 29, 2002

(65) Prior Publication Data

US 2003/0009993 A1 Jan. 16, 2003

(30) Foreign Application Priority Data

May 30, 2001 (IT) ..... BO2001A0346

(51) Int. Cl.[7] ..... B65B 11/30
(52) U.S. Cl. ..... 53/234; 53/230
(58) Field of Search ..... 53/228, 230, 233, 53/234; B65B 11/30, 11/32

(56) References Cited

U.S. PATENT DOCUMENTS 1,485,598 A * 3/1924 Croxford ..... 53/234
1,946,697 A * 2/1934 Johnson et al. ..... 53/234
5,269,117 A * 12/1993 Boriani et al. ..... 53/234
5,305,580 A 4/1994 Draghetti
5,533,323 A 7/1996 Osti et al.
6,035,612 A * 3/2000 Draghetti et al. ..... 53/466

FOREIGN PATENT DOCUMENTS

EP 0 806 350 11/1997
EP 0 860 358 8/1998

* cited by examiner

*Primary Examiner*—John Sipos
(74) *Attorney, Agent, or Firm*—Marshall, Gerstein & Borun LLP

(57) ABSTRACT

A method and unit for forming a tubular wrapping about a rectangular-prism-shaped product, whereby a sheet of packing material is folded about the product in a first folding step, wherein the sheet of packing material is folded into a U about the product so that an end portion of the sheet of packing material projects crosswise with respect to a longitudinal axis of the product and beyond the product itself; and in a second folding step, wherein the end portion is subjected to traction in a direction crosswise to the longitudinal axis of the product, and is simultaneously folded further about the product to define the tubular wrapping.

14 Claims, 1 Drawing Sheet

METHOD AND UNIT FOR FORMING A TUBULAR WRAPPING ABOUT A PRODUCT

The present invention relates to a method of forming a tubular wrapping about a product.

More specifically, the present invention relates to a method of forming a tubular wrapping about a substantially rectangular-prism-shaped product, the method being of the type comprising a first folding step in which a sheet of packing material is folded into a U about the product so that an end portion of the sheet projects crosswise to a longitudinal axis of the product and beyond the product itself; and a second folding step in which said end portion is folded further about the product to define said tubular wrapping.

The present invention may be used to advantage in the tobacco industry for forming tobacco products into packets or packs, and in particular for forming products defined by groups of packets of cigarettes into cartons, to which the following description refers purely by way of example.

BACKGROUND OF THE INVENTION

In the tobacco industry, cartoning machines are used, on which a folding unit is supplied with a succession of groups of packets of cigarettes and relative sheets of packing material—which may be paper or transparent material such as polypropylene—and performs the two folding steps described above to form, about each group of packets, a tubular wrapping coaxial with the longitudinal axis of the group.

U.S. Pat. No. 5,305,580 discloses a machine and a method for forming tubular wrapping about a rectangular-prism-shaped product, in particular a packet of cigarettes. According to such a method a sheet of packing material is folded about the product so as to define the tubular wrapping by means of a rotation of the product around its longitudinal axis.

Experience has shown that, whereas, given the way it is normally carried out, the first folding step normally results in the sheet of packing material adhering perfectly to the group of packets of cigarettes, the same does not always apply to the second step with regard to the projecting end portion of the sheet.

SUMMARY OF THE INVENTION

It is an object of the present invention to provide a packing method designed to eliminate the aforementioned drawback, and which, at the same time, provides for fast, precise wrapping and reduced maintenance. A further object of the present invention is to provide a method which is cheap and easy to implement.

According to the present invention, there is provided a method of forming a tubular wrapping about a rectangular-prism-shaped product, the method comprising a first folding step in which a sheet of packing material is folded into a U about the product so that an end portion of the sheet of packing material projects crosswise to a longitudinal axis of the product and beyond the product itself; and a second folding step in which said end portion is folded further about the product to define said tubular wrapping; and being characterized in that said end portion is subjected, in the course of said second folding step, to traction in a direction crosswise to said longitudinal axis; said first folding step being performed by placing said sheet of packing material in front of, and so as to close, an inlet of a U-shaped pocket for said product; and inserting the product and said sheet of packing material inside said pocket by moving said product against said sheet of packing material and through said inlet.

The present invention also relates to a unit for forming a tubular wrapping.

According to the present invention, there is provided a unit for forming a tubular wrapping about a rectangular-prism-shaped product having a longitudinal axis, the unit comprising first folding means for folding a sheet of packing material into a U about said product so that an end portion of the sheet of packing material projects crosswise to said longitudinal axis and beyond said product; and second folding means for folding said end portion about said product to define said tubular wrapping; and being characterized by also comprising braking means associated with said second folding means and for subjecting said end portion to traction in a direction crosswise to said longitudinal axis.

BRIEF DESCRIPTION OF THE DRAWINGS

A nonlimiting embodiment of the present invention will be described by way of example with reference to the accompanying drawings, in which.

DETAILED DESCRIPTION OF THE INVENTION

Figure 1:
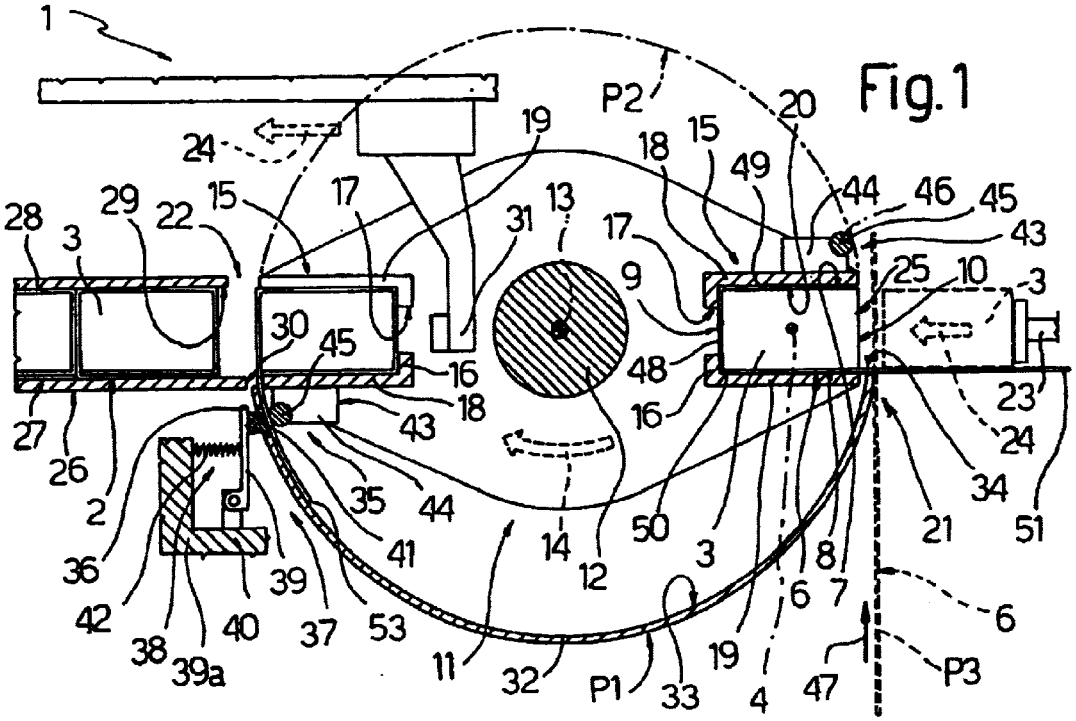
FIG. 1 shows a side view of a preferred embodiment of the folding unit according to the present invention.
Figure 2A:
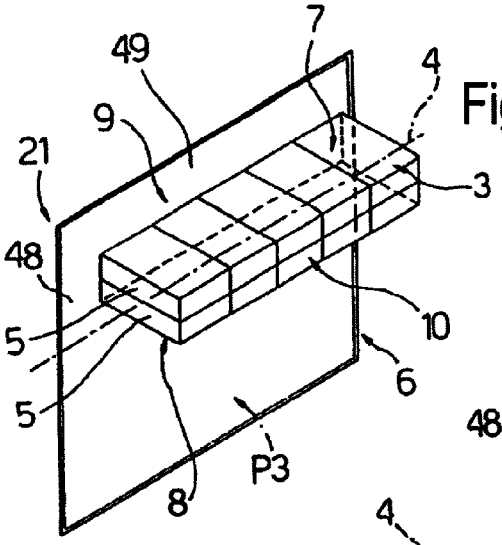
FIG. 2 shows, in perspective, a folding sequence for folding a sheet of packing material about a product.
Figure 2B:
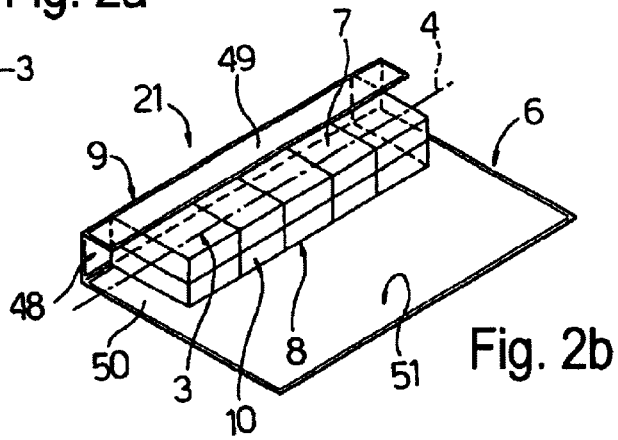
Figure 2C:
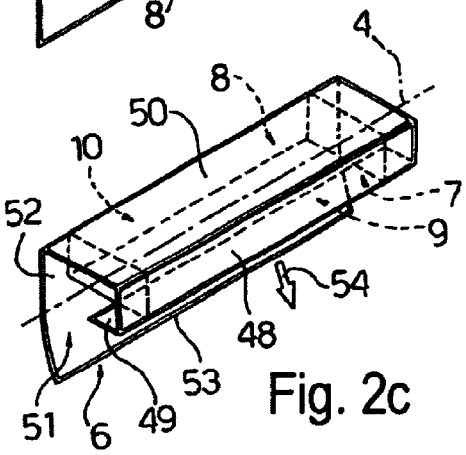
Figure 2D:
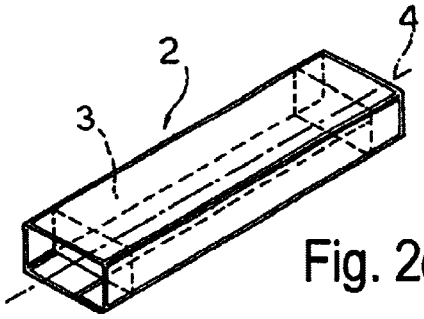

Number 1 in FIG. 1 indicates as a whole a packing unit for forming, as shown in FIG. 2, a tubular wrapping 2 about a rectangular-prism-shaped product 3 having a longitudinal axis 4. In the example shown, product 3 is defined by a group of packets 5 of cigarettes arranged side by side along longitudinal axis 4 in two superimposed layers; and tubular wrapping 2 is coaxial with longitudinal axis 4 and formed by folding a sheet 6 of packing material about product 3 in a direction crosswise to longitudinal axis 4. More specifically, product 3 is defined laterally by two major lateral surfaces 7 and 8 parallel to each other and to longitudinal axis 4, and by two minor lateral surfaces 9 and 10 parallel to each other and to longitudinal axis 4, and perpendicular to major lateral surfaces 7 and 8.

As shown in FIG. 1, unit 1 comprises a packing wheel 11 fitted to a powered shaft 12, which has an axis 13, perpendicular to the FIG. 1 plane, and is rotated in 180° steps about axis 13 in a direction 14 (clockwise in FIG. 1).

Along its outer periphery, packing wheel 11 has two diametrically opposite radial pockets 15, each of which extends, parallel to axis 13, along packing wheel 11, is open both radially outwards and at the axial ends, and is defined by an end wall 16 parallel to axis 13 and having a longitudinal opening 17 parallel to axis 13, and by two facing lateral walls 18 and 19 parallel to axis 13 and perpendicular to end wall 16. Lateral wall 18 is located upstream from lateral wall 19 in direction 14; and lateral walls 18 and 19 of each pocket 15 define, together with relative end wall 16, a relative rectangular-prism-shaped seat 20 for receiving a relative product 3 positioned with its longitudinal axis 4 parallel to axis 13.

Unit 1 also comprises a loading station 21 and an unloading station 22 located diametrically opposite each other outside packing wheel 11, which, at each rotation step of shaft 12 in direction 14, transfers one pocket 15 from loading station 21 to unloading station 22 along a packing path P1, and the other pocket 15 from unloading station 22 to loading station 21 along a return path P2.

Loading station 21 comprises a pusher 23, which moves back and forth in a radial direction 24 with respect to axis 13, and cooperates with the minor lateral surface 10 of a product 3—located at loading station 21 with longitudinal axis 4 parallel to axis 13—to insert product 3 inside a pocket 15—arrested at loading station 21—so that product 3 is positioned, inside relative seat 20, with minor lateral surface 9 substantially contacting relative end wall 16, with major lateral surfaces 7 and 8 substantially contacting relative lateral walls 18 and 19, and with minor lateral surface 10 flush with an inlet 25 of relative seat 20 and with the outer periphery of packing wheel 11.

Unloading station 22 comprises an unloading guide 26 located outside packing wheel 11 and comprising two facing plates 27 and 28 parallel to each other, to axis 13 and to direction 24, and of which plate 28 is located downstream from plate 27 in direction 14. More specifically, plates 27 and 28 are separated by a distance equal to the distance between walls 18 and 19 of each pocket 15, and approximately equal to but no less than the distance between major lateral surfaces 7 and 8 of product 3, and define, between them, an unloading passage 29 for unloading products 3. Plate 27 projects, with respect to plate 28, towards the periphery of packing wheel 11, and is defined, towards packing wheel 11, by an end folding edge 30 parallel to axis 13 and positioned substantially contacting the outer periphery of packing wheel 11 and substantially tangent to the path, coincident with paths P1 and P2, of inlets 25 of seats 20 of pockets 15. Unloading station 22 also comprises a pusher 31, which moves back and forth in direction 24 and cooperates, through opening 17 in a pocket 15 arrested at unloading station 22, with the minor lateral surface 10 of a product 3 housed inside said pocket 15, to expel product 3 from relative seat 20 to unloading guide 26 through unloading passage 29.

Unit 1 also comprises a substantially semicylindrical fixed guide plate 32 coaxial with axis 13 and defined internally by a semicylindrical surface 33 extending along packing path P1 between loading station 21 and unloading station 22. Plate 32 is defined, at the end immediately downstream from loading station 21 in direction 14, by an end folding edge 34 parallel to axis 13, and, immediately upstream from unloading station 22, extends through a braking station 35 comprising an opening 36 formed through plate 32 and parallel to axis 13, and a hammer 37 of a gripper-type braking device 38.

Hammer 37 comprises a lever 39 located outside plate 32 and hinged to a frame 39*a* to rotate, with respect to plate 32, about an axis 40 parallel to axis 13; a pad 41 made of resilient material, fitted integrally to a free end of lever 39, facing plate 32, and movable through opening 36 when lever 39 is rotated about axis 40; and a spring 42 for normally keeping pad 41 in a work position engaging opening 36 and interfering with packing path P1.

In addition to hammer 37, braking device 38 comprises, for each pocket 15, an anvil 43 movable with relative pocket 15 along paths P1 and P2 and comprising a bracket 44 integral with an outer surface of relative lateral wall 18, and a roller 45, which extends along the whole length of relative pocket 15 in the direction of axis 13, is substantially the same length as pad 41, and is fitted to relative bracket 44 to rotate idly, with respect to relative pocket 15, about an axis 46 parallel to axis 13. Roller 45 has at least one peripheral portion made of resilient material, and is positioned with its outer surface tangent to the plane of inlet 25 of relative seat 20.

In actual use, simultaneously with the arrest of an empty pocket 15 at loading station 21, a sheet 6 of packing material (FIGS. 1 and 2*a*) is fed through loading station 21, along a plane P3 tangent to the outer periphery of packing wheel 11 and in a direction 47 crosswise to axis 13, and is arrested with a first intermediate portion 48 facing relative inlet 25 and interposed between inlet 25 and the minor lateral surface 9 of a product 3 ready for loading at loading station 21, and with an end portion 49, generally narrower than major lateral surfaces 7 and 8 of product 3, projecting upstream from relative inlet 25.

Pusher 23 is then activated (FIGS. 1 and 2*b*) to insert product 3 and relative sheet 6 of packing material inside relative seat 20 through relative inlet 25, and so fold sheet 6 of packing material into a U about relative product 3. More specifically, following insertion, sheet 6 of packing material is folded about relative product 3 with end portion 49 contacting part of major lateral surface 7 of relative product 3 and between major lateral surface 7 and lateral wall 18 of relative pocket 15; with intermediate portion 48 contacting minor lateral surface 9 of relative product 3 and between minor lateral surface 9 and end wall 16 of relative pocket 15; with a further intermediate portion 50 contacting major lateral surface 8 of relative product 3 and between major lateral surface 8 and lateral wall 19 of relative pocket 15; and with an end portion 51, opposite end portion 49, projecting radially outwards from relative seat 20 through relative inlet 25 and coplanar with the inner surface of lateral wall 19 of relative pocket 15.

As packing wheel 11 is then fed one step in direction 14, end portion 51 contacts end edge 34 of plate 32 and is folded backwards (FIGS. 1 and 2*c*) so that a portion 52 of end portion 51 contacts minor lateral surface 10 of relative product 3, and an end portion 53 of end portion 51, opposite end portion 49 and generally slightly narrower than major lateral walls 7 and 8, projects rearwards of relative inlet 25, is substantially coplanar with minor lateral surface 10 of relative product 3, and contacts the outer surface of relative roller 45, the distance of which from the rear end of relative inlet 25 is less than the width of end portion 53.

Sheet 6 of packing material remains in this position up to unloading station 22, where, upon operation of pusher 31, end portion 53 is brought into contact with and folded backwards by end edge 30 of plate 27, and, as relative product 3 is inserted inside unloading guide 26, is positioned contacting major lateral surface 7 of relative product 3 and overlapping end portion 49 to complete relative tubular wrapping 2.

Along the final portion of packing path P1, the pocket 15 considered is fed through braking station 35, where pad 41 frictionally engages portion 52 of sheet 6 of packing material, so as to exert braking action on the whole of end portion 51, which is thus maintained contacting minor lateral surface 10 of relative product 3 by tension acting in a direction 54 (FIG. 2*c*) opposite direction 14.

As the pocket 15 considered is arrested at unloading station 22, relative roller 45 is arrested facing opening 36, the distance of which from the upstream end of unloading passage 29 equals the distance between roller 45 and the upstream end of inlet 25 of relative seat 20. Consequently, as the pocket 15 considered is arrested facing unloading passage 29, the tension applied by pad 41 to end portion 51, as a consequence of the rotation of packing wheel 11 and the friction between pad 41 and end portion 51, is maintained by virtue of end portion 53 being gripped between pad 41 and relative roller 45. The same tension is also maintained as product 3 and relative sheet 6 of packing material are inserted inside unloading guide 26 through unloading passage 29 and as end portion 53 is folded, by virtue of end portion 53, as it is folded, still being gripped between hammer 37 and relative anvil 43 of braking device 38, and sliding frictionally between pad 41 and relative roller 45 arrested facing each other with pad 41 pressed against roller 45 by spring 42.

In other words, braking device 38 provides for forming a tubular wrapping 2 adhering perfectly to the lateral surface of relative product 3.

In connection with the above, it should be stressed that braking device 38 is totally passive, and requires no power or control device for its operation.

Obviously, braking device 38 may be replaced with any type of active braking device, such as a suction device (not shown), associated with plate 32.

What is claimed is:

1. A method of forming a tubular wrapping about a rectangular-prism-shaped product, the method comprising a first folding step in which a sheet (6) of packing material is folded into a U about the product (3) so that an end portion (51) of the sheet of packing material projects crosswise to a longitudinal axis (4) of the product (3) and beyond the product (3) itself; and a second folding step in which said end portion (51) is folded further about the product (3) to define said tubular wrapping (2); said end portion (51) being subjected, in the course of said second folding step, to traction in a direction (54) crosswise to said longitudinal axis (4); said first folding step being performed by placing said sheet (6) of packing material in front of, and so as to close, an inlet (25) of a U-shaped pocket (15) for said product (3); and inserting the product (3) and said sheet (6) of packing material inside said pocket (15) by moving said product (3) against said sheet (6) of packing material and through said inlet (25); said traction being applied by feeding said product (3) and said sheet (6) of packing material along a packing path (P1), and by said end portion (51) being engaged by braking means (38) located along said packing path (P1); said braking means (38) comprise an anvil (43) movable with (said product (3) along said packing path (P1); and a hammer (37) located along said packing path (P1), at a braking station (35), and moved across said packing path (P1) by elastic means (42) to grip said end portion (51) against said anvil (43) as said product (3) reaches an unloading station (22) located along said packing path (P1).

2. The method of claim 1, wherein, in the course of said first folding step, said sheet (6) of packing material is folded so as to be positioned with a first end portion (49) contacting at least part of a first lateral surface (7) of said product (3), and with two intermediate portions (48, 50) respectively contacting a second and a third lateral surface (9, 8) of said product (3); said second folding step comprising a first substep in which said end portion (51) is folded on to a fourth lateral surface (10) of said product (3), so that a second end portion (53) projects from said fourth lateral surface (10) and crosswise to said longitudinal axis (4), and a second substep in which said second end portion (53) is folded on to said first lateral surface (7) so as to at least overlap said first end portion (49); said traction being applied to said end portion (51) at least in the course of said second substep.

3. The method of claim 1, wherein said first lateral surface (7) is a major lateral surface (7) of said product (3) and said second lateral surface (9) is a minor lateral surface (9) of said product (3).

4. The method of claim 2, wherein said first substep is performed by feeding said pocket (15) in a feed direction (14) crosswise to said longitudinal axis (4) and along a packing path (P1) extending between a loading station (21), for loading said product (3) and said sheet (6) of packing material into said pocket (15), and said unloading station (22), and by interference between said end portion (51) and folding means (34) located along said packing path (P1); said traction being applied to said end portion (51) by braking means (38) located along said packing path (P1) and downstream from said folding means (34) in said feed direction (14).

5. The method of claim 4, wherein said second substep is performed by expelling said product (3) and said sheet (6) of packing material from said pocket (15) at said unloading station (22) in an unloading direction (24) crosswise to said third lateral surface (8), and by feeding the product (3) and the sheet (6) of packing material through a passage (29) of a width approximately equal to but no smaller than a width of said third lateral surface (8); said second end portion (53) being engaged by said braking means (38) during at least an initial portion of the travel of said product (3) and said sheet (6) of packing material through said passage (29).

6. The method of claim 1, wherein said anvil (43) comprises a roller (45) movable along said packing path (P1) with said product (3), and mounted to rotate idly, with respect to the product (3), about an axis (46) parallel to said longitudinal axis (4).

7. The method of claim 1, wherein at least one peripheral portion of said roller (45) is made of resilient material.

8. The method of claim 1, wherein said hammer (37) comprises a pad (41) of resilient material.

9. A unit for forming a tubular wrapping about a rectangular-prism-shaped product having a longitudinal axis (4), the unit comprising first folding means (20) for folding a sheet (6) of packing material into a U about said product (3) so that an end portion (51) of the sheet (6) of packing material projects crosswise to said longitudinal axis (4) and beyond said product (3); second folding means (34, 30) for folding said end portion (51) about said product (3) to define said tubular wrapping (2); and braking means (38) associated with said second folding means (34, 30) and for subjecting said end portion (51) to traction in a direction (54) crosswise to said longitudinal axis (4) in the course of the folding of said end portion (51) about said product (3) to define said tubular wrapping (2); said traction being applied by feeding said product (3) and said sheet (6) of packing material along a packing path (P1), and by said end portion (51) being engaged by braking means (38) located along said packing path (P1); said braking means (38) comprise an anvil (43) movable with said product (3) along said packing path (P1); and a hammer (37) located along said packing path (P1), at a braking station (35), and moved across said packing path (P1) by elastic means (42) to grip said end portion (51) against said anvil (43) as said product (3) reaches an unloading station (22) located along said packing path (P1).

10. The unit of claim 9, comprising a packing wheel (11) mounted to rotate about an axis (13) of rotation; at least one pocket (15) located on said packing wheel (11) and for receiving a said product (3) positioned with the relative said longitudinal axis (4) parallel to said axis (13) of rotation, said pocket (15) being movable with said packing wheel (11) and in a given feed direction (14) between a loading station (21) and said unloading station (22) along said packing path (P1); an unloading guide (26) positioned with an inlet passage (29) at said unloading station (22); first push means (23) for transferring a said product (3) into said pocket (15) at said loading station (21); and second push means (31) for transferring said product (3) to said unloading guide (26) at said unloading station (22); said braking means (38) being located along said packing path (P1), upstream from said unloading station (22) in said feed direction (14).

11. The unit of claim 9, comprising a fixed plate (32) coaxial with said packing wheel (11) and extending, outside the packing wheel (11), between said loading and unloading stations (21, 22); an opening (36) being formed through said fixed plate (32) at said braking station (35) and at a given first distance from said unloading station (22) for the passage of said hammer (37).

12. The unit of claim 11, wherein said anvil (43) comprises a roller (45) fitted to said packing wheel (11) upstream from said pocket (15) and at a distance from the pocket (15) equal to said first distance; said roller (45) being fitted to said packing wheel (11) to rotate idly, with respect to said pocket (15), about an axis (46) parallel to the axis (13) of rotation of said packing wheel (11).

13. The unit of claim 12, wherein at least one peripheral portion of said roller (45) is made of resilient material.

14. The unit of claim 9, wherein said hammer (37) comprises a pad (41) of resilient material.

* * * * *

UNITED STATES PATENT AND TRADEMARK OFFICE

CERTIFICATE OF CORRECTION

PATENT NO. : 6,675,556 B2
DATED : January 13, 2004
INVENTOR(S) : Bertuzzi et al.

It is certified that error appears in the above-identified patent and that said Letters Patent is hereby corrected as shown below:

Title page,
Item [73], Assignee, "G.D Societa 'per Azioni" should be -- G.D Societa' per Azioni --

Column 5,
Line 39, "(said" should be -- said --

Signed and Sealed this

Thirteenth Day of July, 2004

JON W. DUDAS
*Acting Director of the United States Patent and Trademark Office*